US005114006A

United States Patent [19]

Wilk

[11] Patent Number: 5,114,006

[45] Date of Patent: May 19, 1992

[54] TOOL ASSEMBLY

[76] Inventor: Peter J. Wilk, 185 W. End Ave., New York, N.Y. 10023

[21] Appl. No.: 505,064

[22] Filed: Apr. 5, 1990

[51] Int. Cl.[5] ..... B65D 85/00; E03D 9/00

[52] U.S. Cl. ..... 206/349; 4/255.11

[58] Field of Search ..... 4/255-257, 4/300; 206/349, 361, 15.2, 15.3, 394; 417/437, 470, 472

[56] References Cited

U.S. PATENT DOCUMENTS

| | | | |
|---|---|---|---|
| 4,432,451 | 2/1984 | Hooser | 206/394 |
| 4,776,456 | 10/1988 | Lewis | 206/15.3 |
| 4,922,555 | 5/1990 | Bonilla et al. | 4/257 |
| 5,040,679 | 8/1991 | Rehmann | 206/394 |

FOREIGN PATENT DOCUMENTS

| | | | |
|---|---|---|---|
| 0622195 | 6/1961 | Canada | 206/15.2 |
| 0611145 | 5/1979 | Switzerland | 206/15.2 |
| 0658710 | 10/1951 | United Kingdom | 4/255 |

*Primary Examiner*—Jimmy G. Foster

*Attorney, Agent, or Firm*—R. Neil Sudol; Henry D. Coleman

[57] ABSTRACT

A tool assembly comprises a tool member including an operative element, an elongate extension attached to the operative element, and a flange connected to the extension at an end thereof opposite the operative element. The tool assembly further comprises a housing large enough to contain the tool member, a closure operatively connectable to the housing for enclosing the tool member therein, and at least one locking component for locking the flange to the housing so that the operative element is spaced from the housng. The tool assembly further comprises at least one grip on the housing for enabling a user to manipulate the tool member so as to place the operative element in contact with a surface. The closure member and the tool member are preferably pivotably attached to the housing for rotation about respective axes.

18 Claims, 8 Drawing Sheets 214
226
216
218
224
222
220

226
216
228
224
218
214
222
220

238
230
242
232
234
244
240
236

240
244
230
238
232
234
236

TOOL ASSEMBLY

BACKGROUND OF THE INVENTION

This invention relates to a tool assembly. More particularly, this invention relates to an assembly for a household implement such as a bathroom plunger.

Most households have at least bathroom plunger for removing blockages in drains. Frequently, particularly in those houses having limited storage space or in those houses having pronounced drainage difficulties, plungers sit in open view, beneath the sink or beside the bathtub. Generally, because of their functional design, plungers are not especially pleasant to view. Accordingly, it would be useful to enclose the plunger in an appropriately sized housing, by which means the plunger would still remain easily accessible for immediate use in case of emergency.

Plungers are also unsanitary implements, inasmuch as little care is generally taken to clean them. Such implements are therefore a source of disease bacteria for young children who inhabit floor spaces and are not adverse to intimate tactile association with whatever objects are on the floor.

OBJECTS OF THE INVENTION

An object of the present invention is to provide a plunger or brush device with a housing for hiding the plunger or brush from view.

Another, more particular object of the present invention is to provide such a plunger or brush device with a housing having any of a variety of decorative shapes.

Another object of the present invention is to provide a tool assembly, for use as a household implement such as a bathroom plunger, wherein a housing or casing also serves as a holder.

Yet another object of the present invention is to provide such a tool assembly which serves to maintain sanitary conditions and to prevent young children from playing with household implements which may carry infectious bacteria or viruses.

SUMMARY OF THE INVENTION

A tool assembly comprises, in accordance with the present invention, a tool member including an operative element, an elongate extension attached to the operative element, and a flange connected to the extension at an end thereof opposite the operative element. The tool assembly further comprises a housing large enough to contain the tool member, a closure operatively connectable to the housing for enclosing the tool member therein, and at least one locking component for locking the flange to the housing so that the operative element is spaced from the housing. The tool assembly further comprises at least one grip on the housing for enabling a user to manipulate the tool member so as to place the operative element in contact with a surface.

Pursuant to a particular embodiment of the present invention, the locking component includes a recess in the housing for receiving the flange. In a specific form of this embodiment, the tool member is removable from the housing, the flange being inserted into the recess upon removal of the tool memer from the housing. The closure in this embodiment advantageously includes a door pivotably attached to the housing.

In another specific form of this embodiment of the invention, the locking component includes a plate and an aperture in a wall of the housing traversable by the plate. In that case the tool member is locked to the housing by clamping the flange between the plate and a wall of the housing.

In another specific form of this embodiment of the invention, the locking component includes a surface of the housing. In that case. the tool member is preferably pivotably attached to the housing at an end of the tool member opposite the operative element (i.e., proximately to the flange).

Pursuant to another conceptualization of the invention, a household implement comprises a tool member, a first casing member and a second casing member. The tool member includes an operative element and an extension attached to the operative element. A first coupling component is provided for connecting the extension to the first casing member to enable relative rotation between the tool member and the first casing member about a first axis. A second coupling component is provided for connecting the first casing member to the second casing member to enable relative rotation therebetween about a second axis. The first casing member and the second casing member cooperate to at least substantially enclose the tool member in a storage configuration of the household implement. A grip is provided on at least one of the casing members for enabling a user to manipulate the tool member so as to place the operative element thereof in contact with a surface.

Pursuant to another feature of the present invention, a support is provided for maintaining the tool member in a predetermined orientation with respect to the first casing member and the second casing member in an operative configuration of the implement. The support means includes a planar flange piece rigidly attached to the extension proximately to the first axis and opposite the operative element of the tool member.

Pursuant to different features of the present invention, the second axis is parallel to the first axis or, alternatively, substantially orthogonal to the first axis. In the second case the first axis and the second axis may either lie in a common plane or in different planes spaced from one another.

Pursuant to another feature of the present invention, the hand grip includes an aperture formed in the one of the casing members.

In a specific embodiment of the invention, the casing member are substantially identical to one another.

A tool assembly in accordance with the present invention is particularly useful where the tool member comprises a plunger or a toilet brush. The housing or casing members thereby enclose the plunger or brush and hide that implement from view when it is not being used. When the plunger or brush is to be used, however, the housing or casing becomes an element of the handle and the handgrip for the implement. Accordingly, the length of the handle is effectively doubled by having the housing or casing also serve as a part of the handle (the extension serving as the other part of the handle).

A housing or casing for a plunger or brush or other household utensil may, in accordance with the present invention, assume any of a variety of decorative shapes. For example, the housing or casing may be cylindrical, prismatic, trapezoidal, frustoconical, or bell shaped.

A tool assembly in accordance with the present invention, when used as a plunger or toilet brush design, is also useful to maintain sanitary conditions and to prevent young children from playing with such implements. A locking device may be provided on the housing or casing for purposes of denying access to the implements to young children.

DETAILED DESCRIPTION

Figure 1:
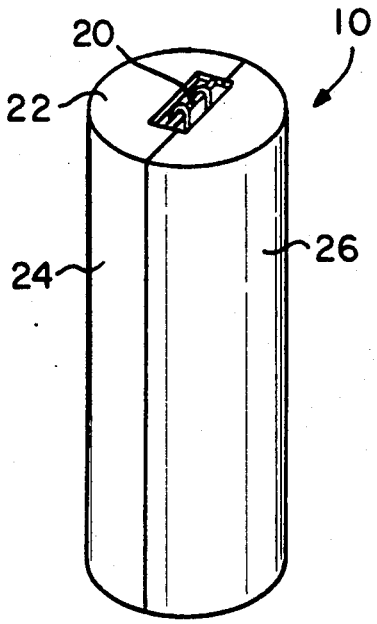
FIG. 1 is a top front perspective view of a plunger and casing combination in accordance with the present invention, showing the casing in a closed configuration.
Figure 2:
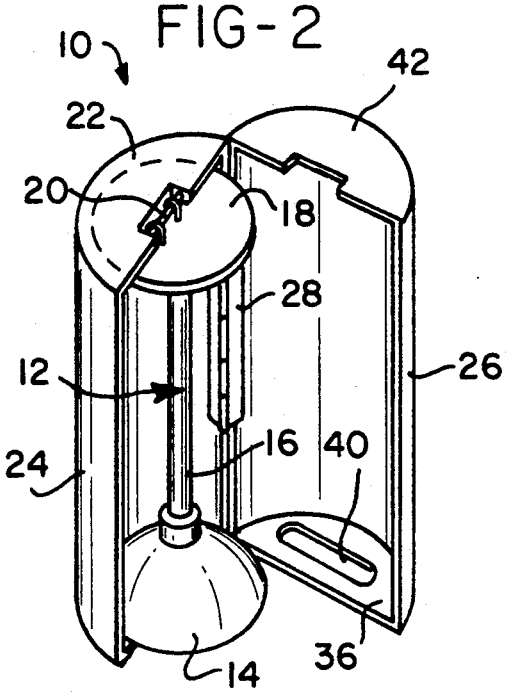
FIG. 2 is a perspective view of the plunger and casing combination of FIG. 1, showing the casing of that drawing figure in an opened configuration and a plunger hanging inside a casing member.
Figure 3:
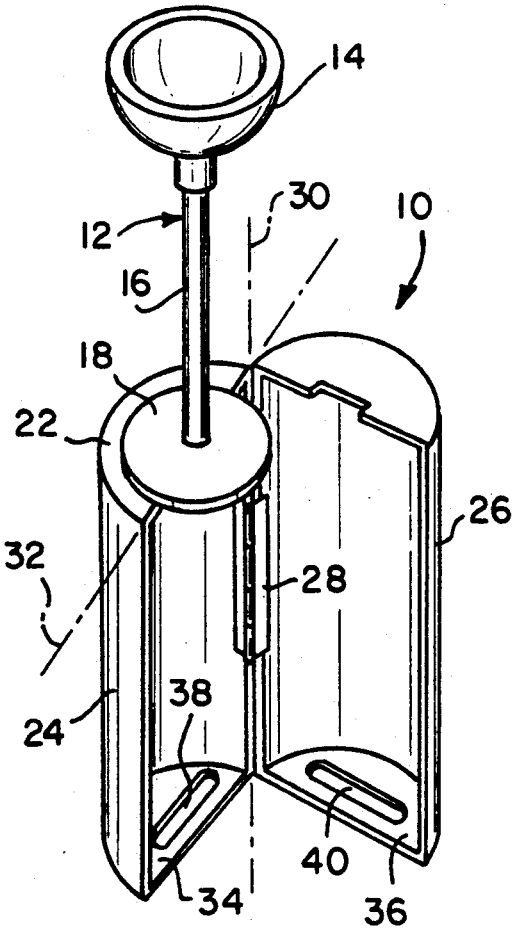
FIG. 3 is a perspective view similar to FIG. 2, showing the casing opened and the plunger in a raised position above the casing.

As illustrated in FIGS. 1–4, a household implement 10 comprises a tool member 12 in the form of a plunger having a plunger head 14 (the operative portion of the plunger) and an elongate extension or handle portion 16. At an upper end, portion 16 is provided with a circular flange 18 and is pivotably attached at a rotatable joint 20 to a substantially D-shaped end wall 22 of a semicylindrical casing member 24. Another semicylindrical casing member 26 of a casing 27 is pivotably connected by a hinge 28 to casing member 24 along a longitudinal pivot axis 30. Pivot axis 30 extends perpendicularly to a transverse pivot axis 32 about which plunger member 12 rotates with respect to casing member 24.

Each casing member 24 and 26 has a D-shaped end wall 34 and 36 opposite rotatable joint 20, the end wall being provided with a respective elongate oval aperture 38 and 40, whereby casing members 24 and 26 may be grasped by a user. Accordingly, upon the opening of casing members 24 and 26 by pivoting them relative to one another about axis 30 (compare FIGS. 1 and 2), the swinging of plunger member 12 from a storage position inside casing member 24 to a use position shown in FIGS. 3 and 4, and a subsequent closing of the casing members 24 and 26, the plunger and casing combination is ready for use.

Figure 4:
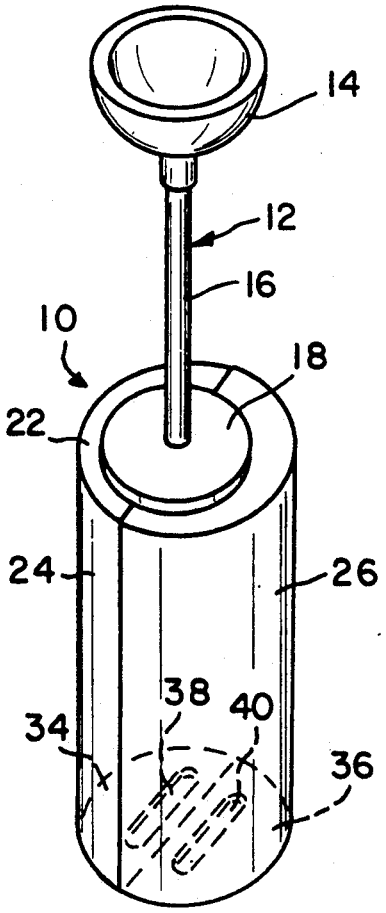
FIG. 4 is a perspective view similar to FIGS. 1-3, showing the casing in a closed configuration and the plunger in an operative or use position outside the casing.
Figure 5:
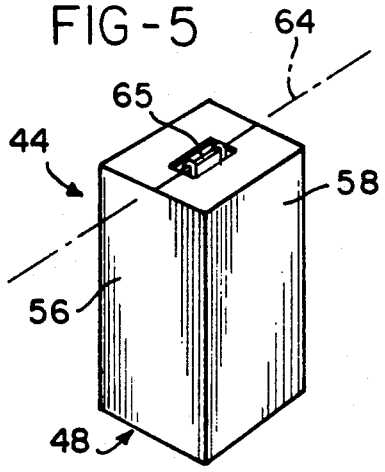
FIG. 5 is a perspective view, similar to FIG. 1 of another plunger and casing combination in accordance with the present invention, with the casing in a closed, storage configuration.
Figure 6:
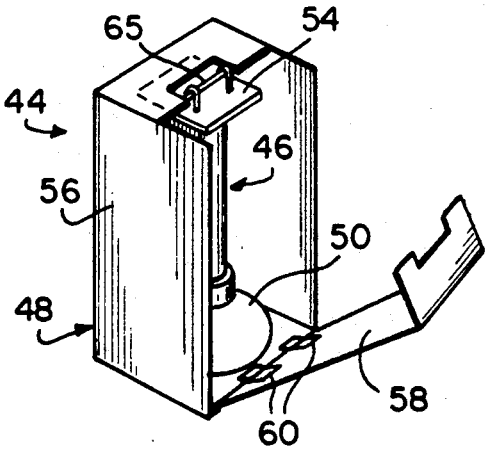
FIG. 6 is a perspective view, similar to FIG. 2, of the plunger and casing combination of FIG. 5, showing the casing of FIG. 5 in an opened configuration and a plunger hanging inside a casing member.
Figure 7:
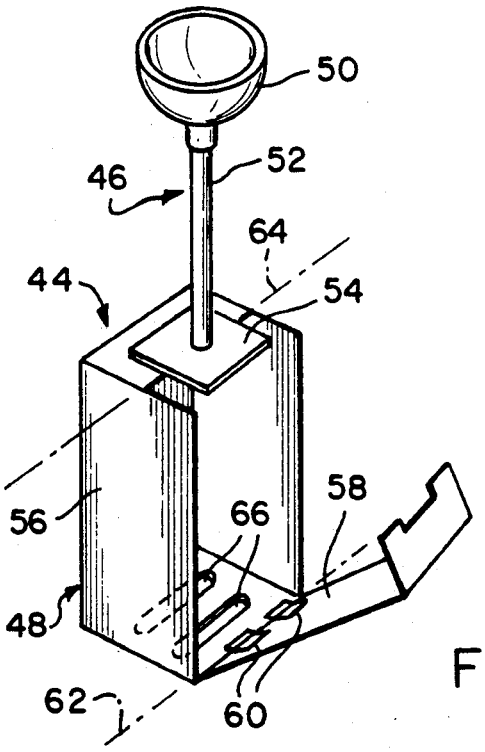
FIG. 7 is a perspective view, similar to FIG. 3, of the plunger and casing combination of FIGS. 5 and 6, showing the casing opened and the plunger in a raised position above the casing.
Figure 8:
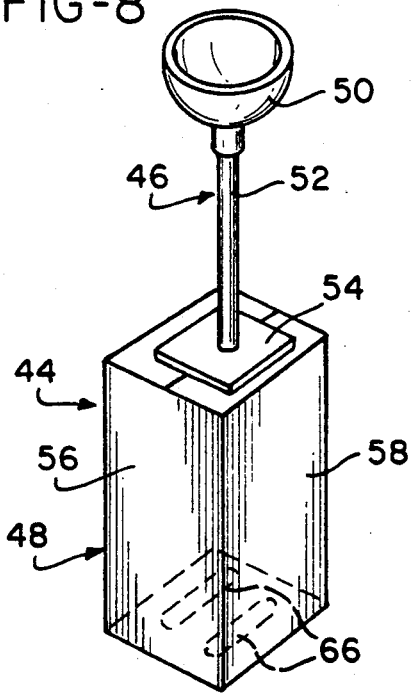
FIG. 8 is a perspective view, similar to FIG. 4, of the plunger and casing combination of FIGS. 5-7, showing the casing in a closed configuration and the plunger in an operative or use position outside the casing.

It is to be noted that flange 18 rests against D-shaped end walls 22 and 42 in the operative configuration of FIG. 4, whereby plunger member 12 is locked into a substantially colinear or coaxial position with respect to casing 27.

As depicted in FIGS. 5–8, another household tool assembly or implement 44 comprises a plunger member 46 and a casing or housing 48. Plunger member 46 includes an operative head portion 50 and an elongate handle portion 52 provided at an end opposite head portion 50 with a rectangular flange 54. Housing 48 includes a main housing component 56 and a cross-sectionally L-shaped door 58 swingably linked to the main housing component by a pair of hinge elements 60. L-shaped door 58 pivots about an axis 62 oriented parallel to another axis 64 about which plunger member 46 rotates with respect to housing component 56. Plunger member 46 is rotatably connected to housing component 56 via a hinge 65. An end wall of housing component 56 is provided with a pair of elongate oval openings 66 for enabling a grasping of housing 48 by a user.

Figure 9:
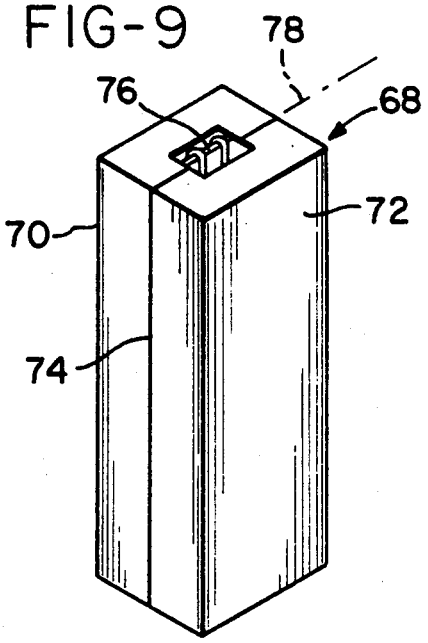
FIGS. 9-12 are perspective views of four casing shapes usable as alternatives to a cylindrical shape shown in FIG. 1.

FIG. 9 shows a casing 68 for use in the plunger and casing combination of FIGS. 1–4. Casing 68 is prismatic, rather than cylindrical, and has two casing halves 70 and 72 pivotably connected to one another along a longitudinally extending joint 74. A plunger (not shown) is rotatably coupled to casing half 70 by a swinging connector 76, whereby the plunger pivots relative to casing half 70 about a transverse axis 78.

Figure 10:
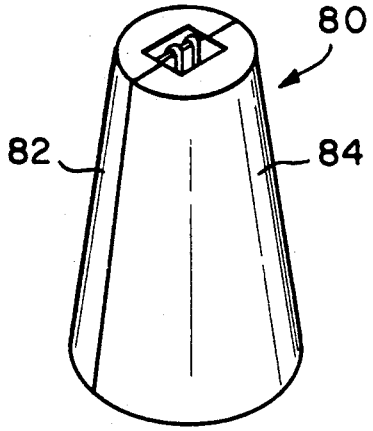
Figure 11:
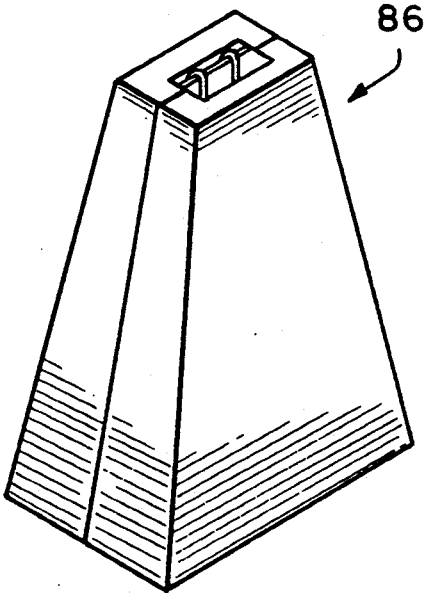
Figure 12:
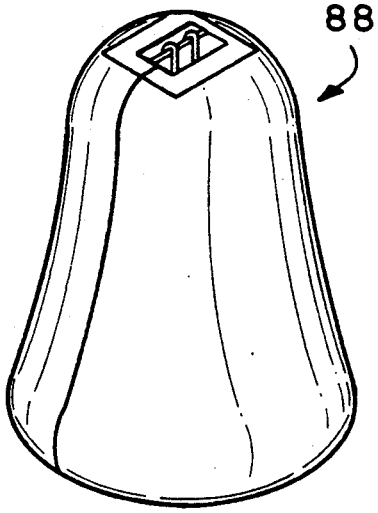
Figure 13:
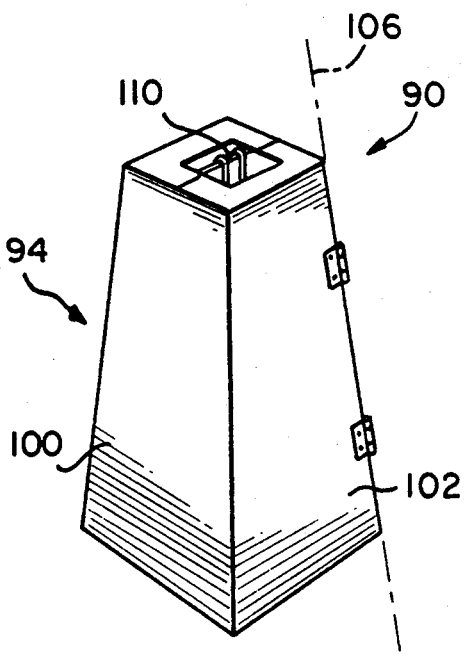
FIG. 13 is a perspective view, similar to FIG. 1 of another plunger and casing combination in accordance with the present invention, with the casing in a closed, storage configuration.
Figure 14:
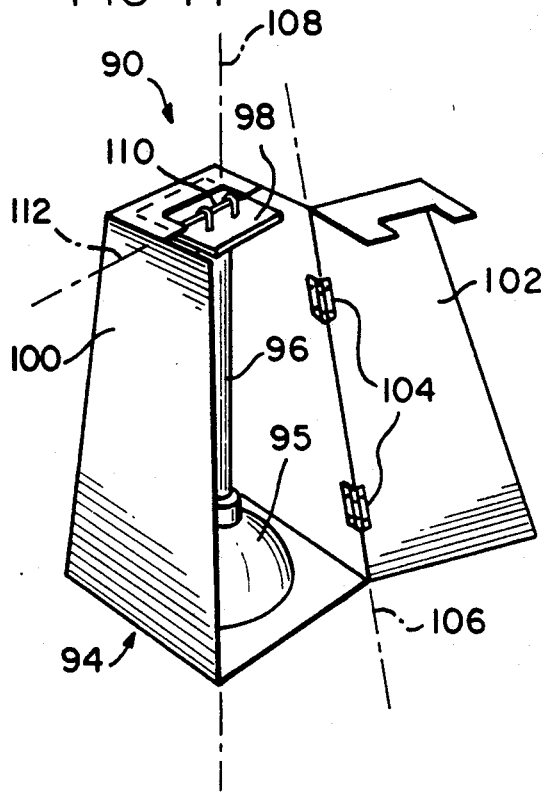
FIG. 14 is a perspective view, similar to FIG. 2, of the plunger and casing combination of FIG. 13, showing the casing of FIG. 13 in an opened configuration and a plunger hanging inside a casing member.
Figure 15:
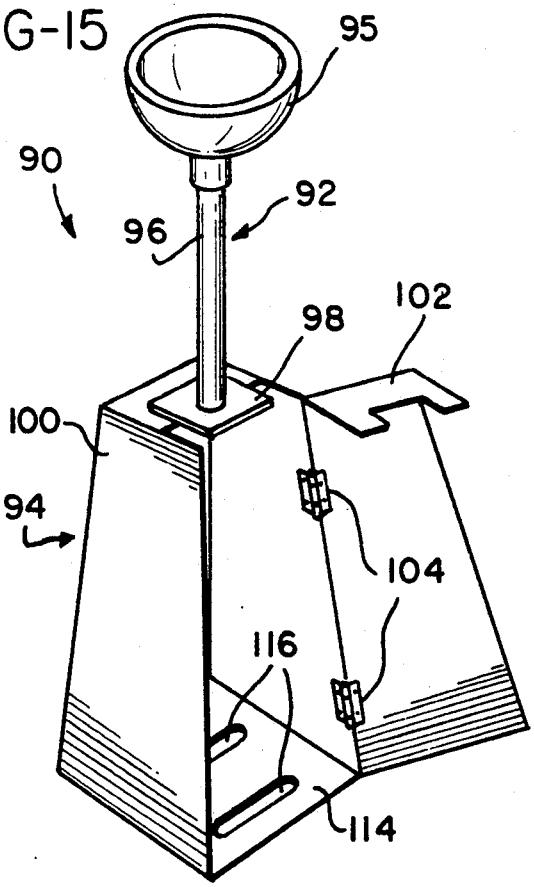
FIG. 15 is a perspective view, similar to FIG. 3, of the plunger and casing combination of FIGS. 13 and 14, showing the casing opened and the plunger in a raised position above the casing.
Figure 16:
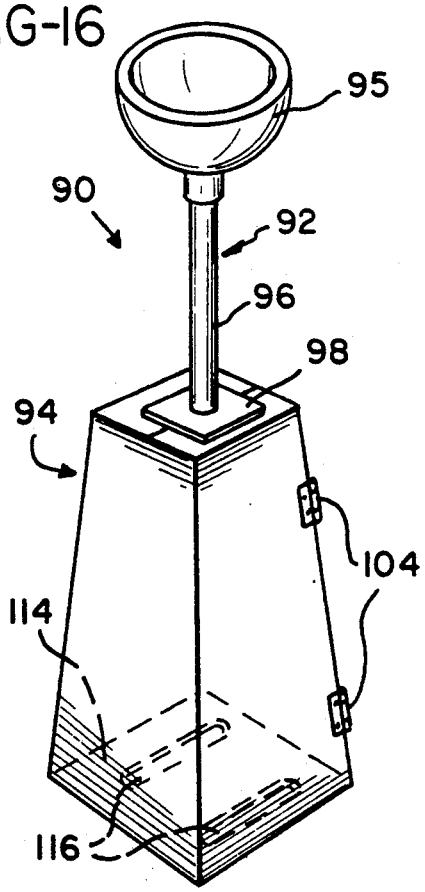
FIG. 16 is a perspective view, similar to FIG. 4, of the plunger and casing combination of FIGS. 13-15, showing the casing in a closed configuration and the plunger in an operative or use position outside the casing.

FIG. 10 illustrates a frustoconical housing 80 having two casing halves 82 and 84, while FIG. 11 shows a frustopyramidal casing 86. A bell-shaped casing 88 is depicted in FIG. 12. The plunger casings 80, 86 and 88 are all provided with hand grips for facilitating a manipulation of the respective plunger and casing combination by a user.

Yet another plunger and casing combination is shown in FIGS. 13–16. A household tool assembly or implement 90 comprises a plunger member 92 and a casing or housing 94. Plunger member 92 includes a substantially semispherical rubber head 94 and an elongate handle portion 96 provided at an end opposite the head portion with a rectangular flange 98. Housing 94 includes a main housing component 100 and a cross-sectionally L-shaped door 102 swingably linked to the main housing component by a pair of hinge elements 104. L-shaped door 102 pivots about an axis 106 oriented at an angle with respect to a longitudinal axis 108 of housing 94. Plunger member 92 rotates with respect to housing component 100 by virtue of a hinge 110 defining an axis of rotation 112. An end wall 114 of housing component 100 is provided with a pair of elongate oval openings 116 for enabling a grasping of housing 94 by a user. As desribed hereinabove, flange 98 serves to stabilize plunger member 92 with respect to housing 94 in the operative configuration of FIG. 16.

Figure 17:
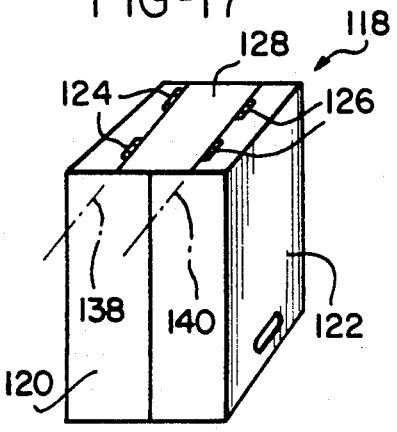
FIG. 17 is a top, side perspective view of yet another plunger and casing combination in accordance with the present invention, showing a closed casing.
Figure 18:
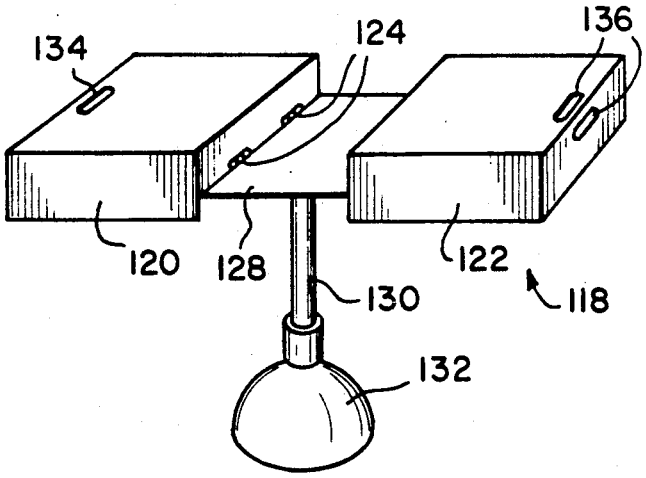
FIG. 18 is a top perspective view of the plunger and casing combination of FIG. 17 with a pair of partially raised or pivoted casing members.
Figure 19:
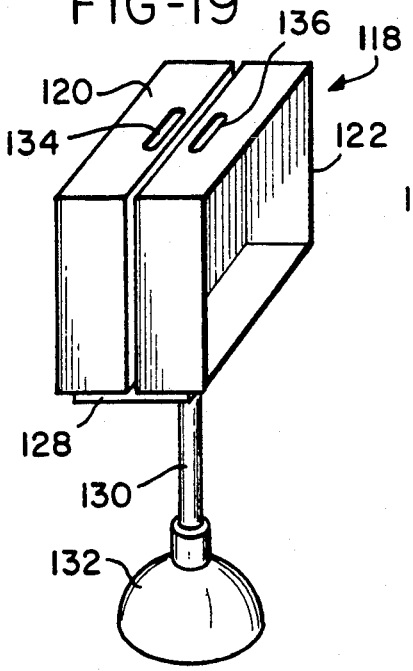
FIG. 19 is a top perspective view of the plunger and casing combination of FIGS. 17 and 18, showing the casing members in a fully raised, operative configuration.

As shown in FIGS. 17–19, another plunger and casing assembly 118 includes a pair of essentially identical box-shaped casing halves 120 and 122 each pivotably coupled by a respective pair of hinges 124 and 126 to a rectangular plate 128 in turn fastened to the end of a plunger handle member 130 opposite a cup-shaped rubber plunger element 132. Each of the box-shaped casing halves 120 and 122 has an open side which faces outwardly in the fully opened configuration of FIG. 19 and inwardly in the closed configuration of FIG. 17. Each casing half 120 and 122 is provided with a pair of elongate essentially oval holes 134 and 136 which enable a user to grib the assembly in its fully opened, opeative configuration (FIG. 19).

In the embodiment of FIGS. 17–19, casing halves 120 and 122 are pivotable relative to one another and relative to plunger plate 128 about respective axes 138 and 140. Plate 128 cooperates with casing halves 120 and 122 to fix the plunger element relative to the casing in the operative configuration.

Figure 21:
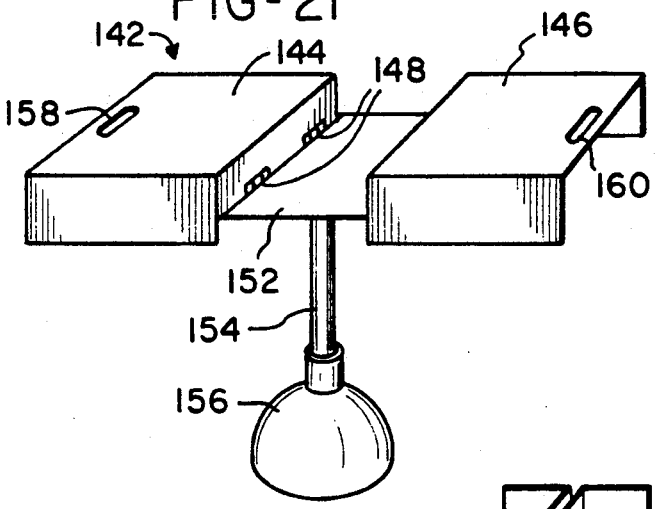
FIG. 21 is a top perspective view of the plunger and casing combination of FIG. 20 with a pair of partially raised or pivoted casing members.
Figure 20:
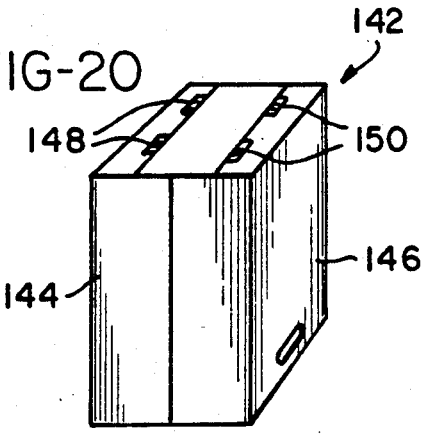
FIG. 20 is a top, side perspective view of yet another plunger and casing combination in accordance with the present invention, showing a closed casing.
Figure 22:
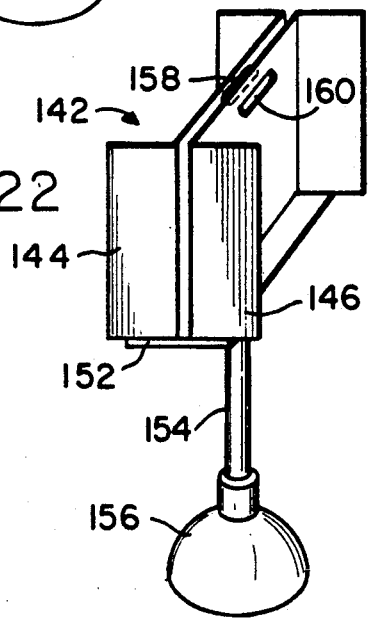
FIG. 22 is a top perspective view of the plunger and casing combination of FIGS. 20 and 21, showing the casing members in a fully raised, operative configuration.

As illustrated in FIGS. 20–22, yet another plunger and casing assembly 142 includes a pair of essentially identical U-shaped housing portions 144 and 146 each pivotably coupled by a respective pair of hinges 148 and 150 to a rectangular plate 152 in turn fastened to the end of a plunger handle member 154 opposite a cup-shaped rubber plunger element 156. Each of the housing portions 144 and 146 has an open side which faces outwardly in the fully opened configuration of FIG. 22 and inwardly in the closed configuration of FIG. 20. In addition, each housing portion 144 and 146 includes a second open side which faces away from plunger element 156 in the operative configuration (FIG. 22). Each housing portion 144 and 146 is provided with an elongate essentially oval aperture 158 and 160 which together enable a user to grib the assembly in its fully opened, opeative configuration (FIG. 22).

Figure 23:
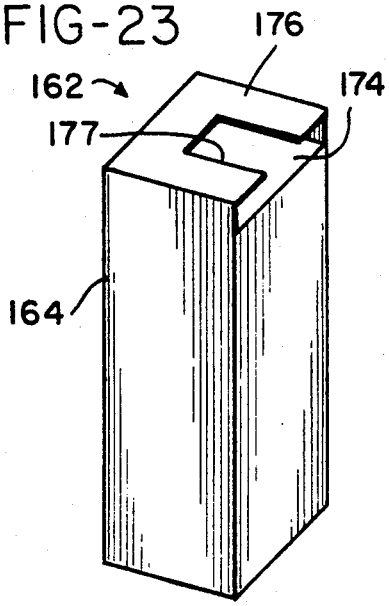
FIG. 23 is a top perspective view of an additional plunger and casing combination in accordance with the present invention, showing the casing in a closed configuration.
Figure 29:
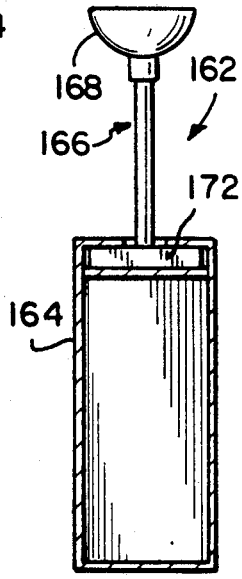
FIG. 29 is a side view of the plunger and casing combination of FIGS. 23 and 24 in the use configuration of FIG. 28.
Figure 24:
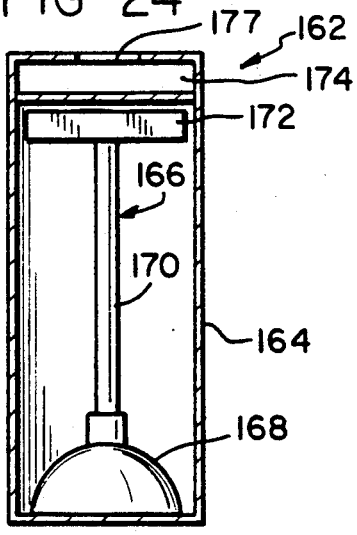
FIG. 24 is a vertical cross-sectional view of the plunger and casing combination of FIG. 23, showing a plunger inside the casing.
Figure 25:
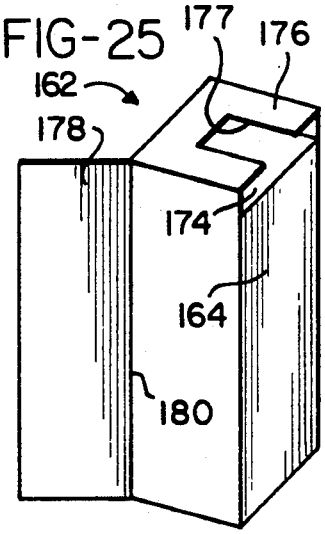
FIGS. 25, 26 and 27 are top perspective views showing the plunger and casing combination of FIGS. 23 and 24 with three alternative casing doors.
Figure 26:
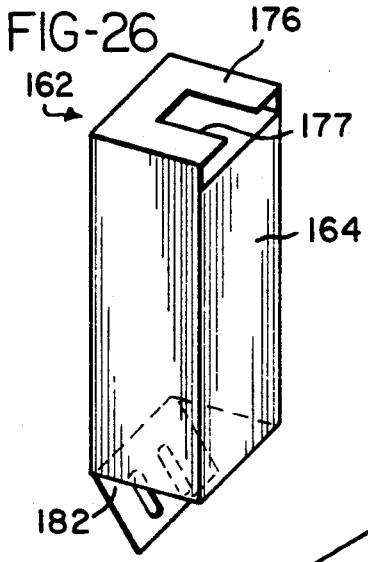
Figure 27:
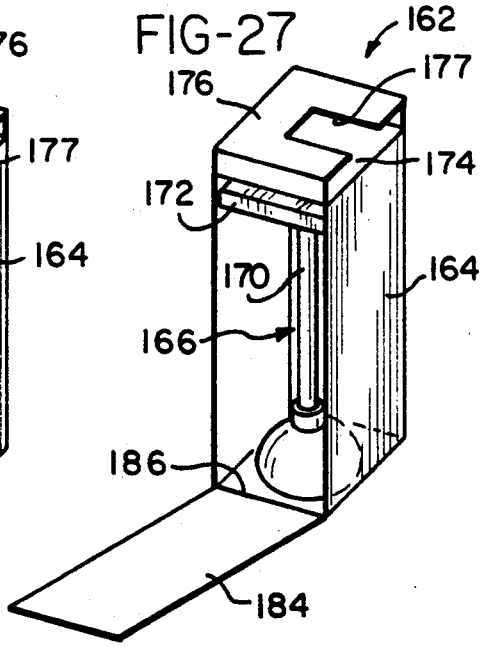
Figure 28:
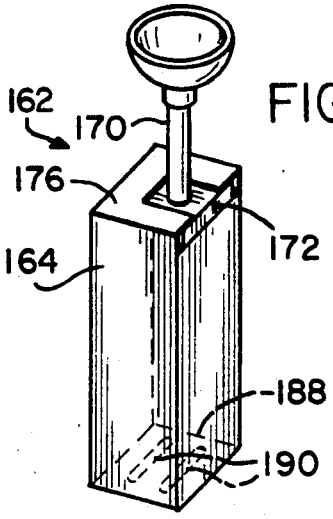
FIG. 28 is a top perspective view of the plunger and casing combination of FIGS. 23 and 24, showing the plunger removed and attached to the casing, ready for use.

FIGS. 23 and 24 show another plunger and casing assembly 162 in a closed storage configuration. The assembly includes a box-like housing or casing 164 and a plunger 166 with a cup-shaped flexible head portion 168, an elongate handle 170 and a rectangular terminal flange 172 positioned at an end of handle 170 opposite head portion 168. At one end, housing 164 is provided with a flat chamber 174 for receiving flange 172, as illustrated in FIGS. 28 and 29. An end wall 176 is provided with a slot 177 traversed by handle 170 in the operative configuration of the plunger and casing assembly. Housing 164 may be accessed through a side door 178 pivotably attached to the main body of the housing along a longitudinal joint 180 (FIG. 25), a pivotably attached bottom door 182 (FIG. 26), or a side door 184 pivotably attached to the main body of the housing along a transverse joint 186 (FIG. 27). In an end wall 188 opposite chamber 174, housing 164 is provided with a pair of elongate apertures 190 serving to facilitate a grasping of the housing by a user.

Figure 30:
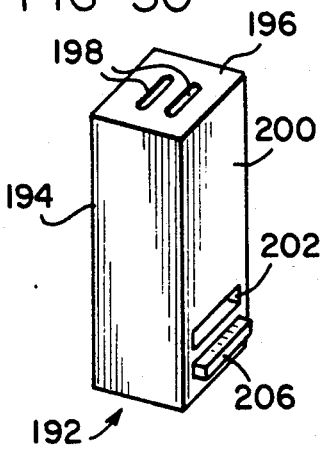
FIG. 30 is a top perspective view of a further plunger and casing combination in accordance with the present invention, showing the casing with a closure plate in a closure position.
Figure 31:
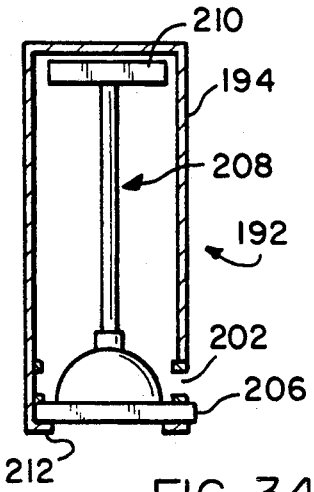
FIG. 31 is a vertical cross-sectional view of the plunger and casing combination of FIG. 30, showing a plunger inside the casing.
Figure 32:
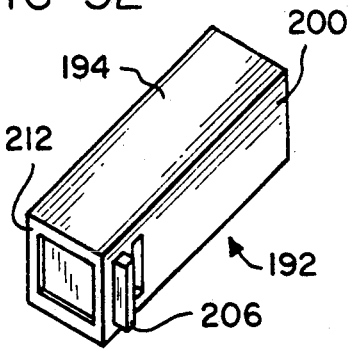
FIG. 32 is a bottom perspective view of the plunger and casing combination of FIGS. 30 and 31, showing the closure plate in the closure position.
Figure 33:
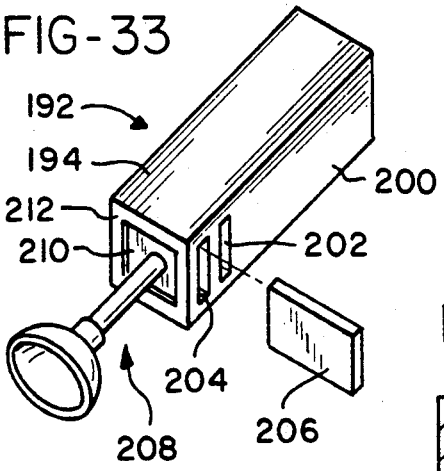
FIG. 33 is the same view as FIG. 32, with the closure plate removed and the plunger withdrawn from the casing.
Figure 34:
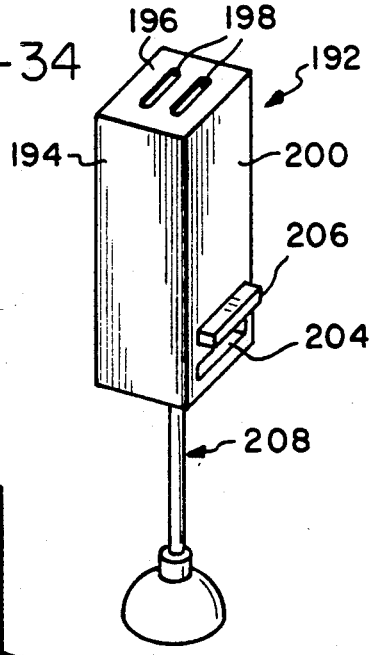
FIG. 34 is a top perspective view of the plunger and casing combination of FIGS. 30-33, showing the closure plate reinserted into the casing to hold the plunger in the extended use configuration.
Figure 35:
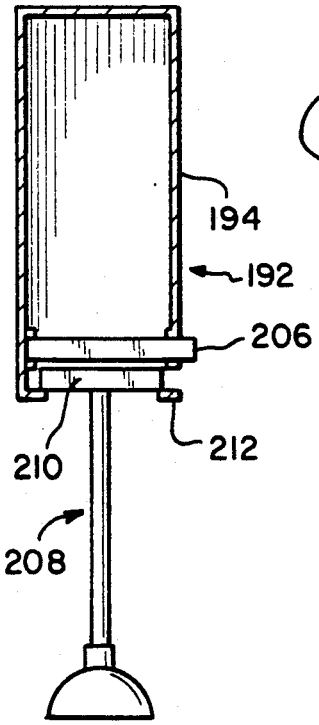
FIG. 35 is a vertical cross-sectional view of the plunger and casing combination of FIGS. 30-34, showing the plunger in the extended use configuration.
Figure 36:
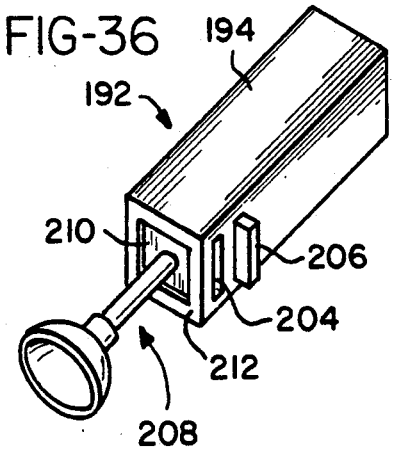
FIG. 36 is a bottom perspective view of the plunger and casing combination of FIGS. 30-35, showing the closure plate in the closure position and the plunger extended.

FIGS. 30 and 31 show yet another plunger and casing assembly 192 in a closed storage configuration. A housing 194 is provided in one end wall 196 with a hand grip formed by a pair of openings 198. In a side wall 200 at an end thereof opposite end wall 196, housing 194 is formed with a pair of slots 202 and 204. Slot 202 receives a plate 206 for closing a plunger 208 inside housing 194 in a storage configuration of the plunger and casing assembly 192 (see FIG. 31). Slot 204 receives the same plate 206 for locking or holding plunger 208 in an extended or withdrawn position relative to housing 194. In that position of the plunger, a flange 210 at the end of plunger 208 is clamped between plate 206 and a rim 212 of housing 194 opposite end wall 196 (see FIGS. 34–37). It is within the contemplation of the invention that slots 202 and 204 may be provided in different side walls of housing 194 and that a different plate or other member (not shown) may be used to lock plunger 208 in the operative position.

Figures 37, 38, 39, 40:
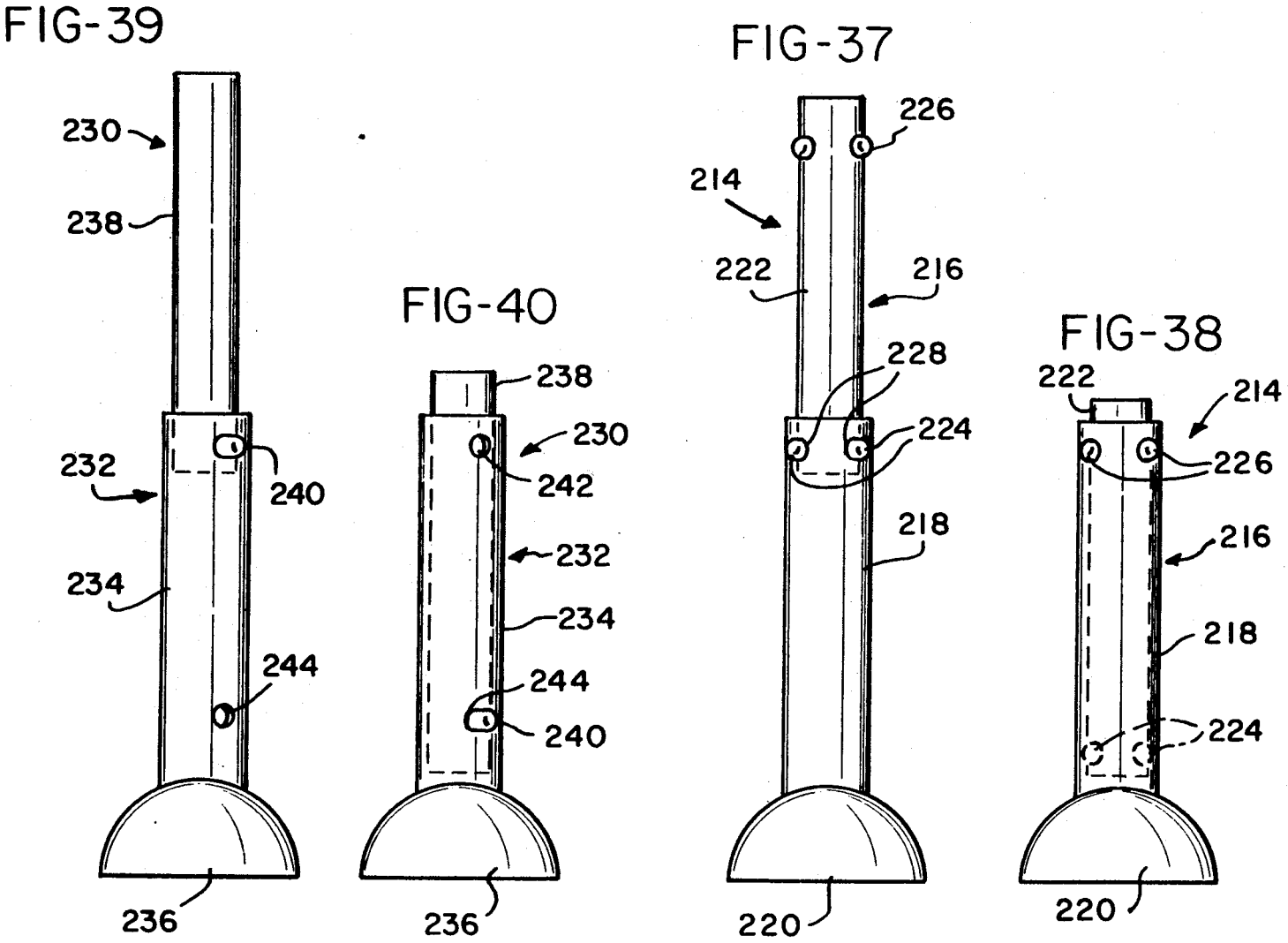
FIG. 37 is a front elevational view of a plunger in accordance with the present invention, showing a telescoping handle in an extended configuration.
FIG. 38 is a view similar to FIG. 37, showing the plunger of that drawing figure with its handle in a collapsed configuration.
FIG. 39 is a front elevational view of another plunger in accordance with the present invention, showing a telescoping handle in an extended configuration.
FIG. 40 is a view similar to FIG. 39, showing the plunger of that drawing figure with its handle in a collapsed configuration.

As depicted in FIGS. 37 and 38, a collapsible plunger 214 includes a handle 216 with a first tubular handle part 218 connected at one end to a cup-shaped flexible plunger head 220 and a second tubular handle part 222 telescopingly received inside the first tubular handle part. Inner handle part 222 is provided at one end with a first plurality of spring loaded buttons 224 and at an opposite end with an identical array of spring loaded buttons 226. Buttons 224 traverse respective openings 228 in an end of outer handle part 218 opposite plunger head 220 to lock the tubular handle parts 218 and 222 to one another in an extended use configuration. Similarly, buttons 226 cooperate with the same openings 228 to lock the tubular handle parts 218 and 222 to one another in a collapsed, storage configuration (FIG. 38).

As depicted in FIGS. 39 and 40, a further collapsible plunger 230 includes a handle 232 with a first tubular handle part 234 connected at one end to a cup-shaped flexible plunger head 236 and a second tubular handle part 238 telescopingly received inside the first tubular handle part. Inner handle part 238 is provided at one end with a spring loaded button 240, while outer handle part 234 is provided with a pair of apertures 242 and 244 at opposite ends for receiving button 240 in an extended, operative configuration and a collapsed, storage configuration, respectively.

Figure 41:
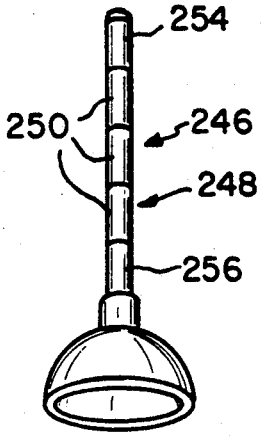
FIG. 41 is a front elevational view of yet another plunger in accordance with the present invention, showing a collapsable handle in a linear operative configuration.
Figure 42:
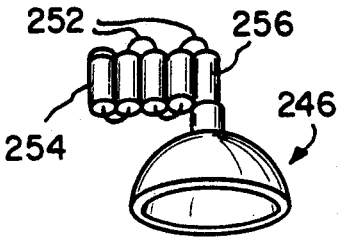
FIG. 42 is a view similar to FIG. 41, showing the plunger of that drawing figure with its handle in a collapsed storage configuration.
Figure 43:
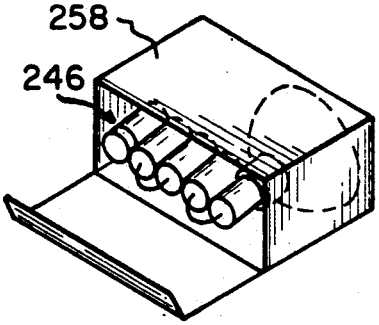
FIG. 43 is a perspective view of a plunger and casing combination including the plunger of FIGS. 41 and 42 in the collapsed configuration.

As shown in FIGS. 41–43, an additional collapsible plunger 246 includes a handle 248 comprising a plurality of hollow shaft members 250 connected to one another by a tensile cord 252 fastened at its opposite ends to outer shaft members 254 and 256. The shaft members are held in a linear operative configuration by the tensile cord 252. Upon a stetching of the cord, the shaft members 250 can be separated and placed side by side in a folded storage configuration (FIG. 42). FIG. 43 shows the collapsed plunger 246 in a storage box 258.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. A household implement comprising:

a tool member including an operative element and an extension attached to said operative element;

a first casing member;

a second casing member;

first coupling means for connecting said extension to said first casing member to enable relative rotation between said tool member and said first casing member about a first axis;

second coupling means for connecting said first casing member to said second casing member to enable relative rotation therebetween about a second axis, said first casing member and said second casing member cooperating to at least substantially enclose said tool member in a storage configuration of the household implement; and gripping means on at least one of said first casing member and said second casing member for enabling a user to manipulate said tool member so as to place said operative element in contact with a surface.

2. The implement according to claim 1, further comprising support means for maintaining said tool member in a predetermined orientation with respect to said first casing member and said second casing member in an operative configuration of the implement.

3. The implement according to claim 2 wherein said support means includes a planar flange piece rigidly attached to said extension proximately to said first axis and opposite said operative element.

4. The implement according to claim 1 wherein said second axis is parallel to said first axis.

5. The implement according to claim 1 wherein said second axis is substantially orthogonal to said first axis.

6. The implement according to claim 5 wherein first axis and said second axis lie in a common plane.

7. The implement according to claim 5 wherein said second axis is located in a plane spaced from said first axis.

8. The implement according to claim 1 wherein said gripping means includes an aperture formed in said one of said first casing member and said second casing member.

9. The implement according to claim 1 wherein said first casing member and said second casing member are substantially identical to one another.

10. The implement according to claim 9 wherein first axis and said second axis are parallel to one another.

11. The implement according to claim 1 wherein first casing member comprises a housing and said second casing member comprises a door attached via said second coupling means to said housing.

12. The implement according to claim 1 wherein said tool member comprises a plunger and said extension comprises an elongate rod component.

13. A tool assembly comprising:

a tool member including:

(i) an operative element;

(ii) an elongate extension attached to said operative element; and (iii) a flange connected to said extension at an end thereof opposite said operative element;

a housing large enough to contain said tool member;

closure means operatively connectable to said housing for enclosing said tool member therein;

locking means for locking said flange to said housing so that said operative element is spaced from said housing; and gripping means on said housing for enabling a user to manipulate said tool member so as to place said operative element in contact with a surface.

14. The implement according to claim 13 wherein said locking means includes a recess in said housing for receiving said flange.

15. The implement according to claim 13 wherein said closure means includes a door pivotably attached to said housing.

16. The implement according to claim 13 wherein said locking means includes a plate and an aperture in a wall of said housing traversable by said plate.

17. The implement according to claim 13 wherein said locking means includes a surface of said housing.

18. The implement according to claim 13 wherein said tool member is pivotably attached to said housing at an end of said tool member opposite said operative element.

* * * * *

UNITED STATES PATENT AND TRADEMARK OFFICE

CERTIFICATE OF CORRECTION

PATENT NO. : 5,114,006

DATED : May 19, 1992

INVENTOR(S) : Peter J. Wilk

It is certified that error appears in the above-identified patent and that said Letters Patent is hereby corrected as shown below:

On the title page, in the designation of inventor, insert, --Marilyn Michaels Wilk;-- before "Peter J. Wilk" and insert --both of-- before "185".

In the Abstract, line 10, change "housng" to --housing--.

Col. 1, line 8, insert --one-- after "at least"; line 63, change "memer" to --member--.

Col. 2, line 47, change "member" to --members--.

Col. 6, line 18, change "desribed" to --described--; lines 33 and 57, change "opeative" to --operative--.

Col. 7, line 61, change "stetching" to --stretching--.

Column 8:

Claim 6, line 1, insert --said-- after "wherein".

Claim 10, line 1, insert --said-- after "wherein".

Claim 11, line 1, insert --said-- after "wherein".

Signed and Sealed this

Fourteenth Day of June, 1994

*Attest:*

*Attesting Officer*

Bruce Lehman

BRUCE LEHMAN

*Commissioner of Patents and Trademarks*